US007393212B2

(12) United States Patent
Parker

(10) Patent No.: US 7,393,212 B2
(45) Date of Patent: Jul. 1, 2008

(54) ROTATING POWER RECEPTACLE

(75) Inventor: Jeffrey C. Parker, Magnolia, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 120 days.

(21) Appl. No.: 11/238,325

(22) Filed: Sep. 29, 2005

(65) Prior Publication Data

US 2007/0070582 A1 Mar. 29, 2007

(51) Int. Cl.
*H01R 39/00* (2006.01)

(52) U.S. Cl. ..... 439/8; 439/9

(58) Field of Classification Search ..... 439/6–11, 439/18–31, 17, 534, 131
See application file for complete search history.

(56) References Cited

U.S. PATENT DOCUMENTS

| | | | | |
|---|---|---|---|---|
| 5,927,999 | A * | 7/1999 | Shimojyo | 439/63 |
| 6,093,038 | A * | 7/2000 | Chen et al. | 439/131 |
| 6,190,180 | B1 | 2/2001 | Purington et al. | |
| 6,406,314 | B1 | 6/2002 | Byrne | |
| 6,544,069 | B1 | 4/2003 | Enriquez, Sr. et al. | |
| 6,554,648 | B2 * | 4/2003 | Shi et al. | 439/607 |
| 7,066,753 | B1 * | 6/2006 | Tseng | 439/259 |
| 7,128,595 | B2 * | 10/2006 | Boutros | 439/358 |
| 2004/0043665 | A1 | 3/2004 | Chen | |
| 2004/0221458 | A1 | 11/2004 | Pleshok | |
| 2005/0208344 | A1 | 9/2005 | Tan | |

FOREIGN PATENT DOCUMENTS

| | | |
|---|---|---|
| JP | 09 017460 | 1/1997 |

OTHER PUBLICATIONS

Power Delivery Systems, Inc., Internet Advertisement: "Rotating Electrical Connector", Jul. 12, 2005, Published in: US.

* cited by examiner

*Primary Examiner*—Ross N Gushi

(57) ABSTRACT

A rotating power receptacle for an electronic device is provided. The power receptacle includes a socket, coupled to a circuit board, and providing power to an electronic device. The power receptacle also includes a post connector that is in rotating contact with the socket. The power receptacle further includes a flexible ground spring, coupled to the circuit board; the flexible ground spring extending adjacent to the post connector and providing a ground connection for the electronic device. The power receptacle also includes a rotating member that is positioned in an opening in a housing of the electronic device. The rotating member has an opening through which a power supply connector is enabled to connect to the post connector and the flexible ground spring to provide a rotating power connection for the electronic device.

23 Claims, 3 Drawing Sheets

ROTATING POWER RECEPTACLE

BACKGROUND

Many electronic devices are portable, e.g., notebook computers, laptop computers, tablet computers, hand-held computers, digital cameras, portable disk drives, wireless telephones, personal digital assistants (PDAs), and audio/video players and recorders. To function, these devices need a power source. Although such devices are often battery powered, it is also common to provide power through connection to another source of electrical power, e.g., an electrical outlet. Connection to such sources of power is typically accomplished through a power adapter.

A typical power adapter is configured with a power converter that is connected by two cables between the electronic device and the power source. One cable includes a jack or connector that is adapted to connect to a power receptacle of the electronic device. The power receptacle of the electronic device is typically connected directly to a circuit board, e.g., mother or daughter board, of the electronic device. The second cable of the power adaptor includes a plug for connecting to the power source. Some power adapters include only one cable between the power converter and the electronic device. In this case, the connection to the power source is built into the power converter.

Unfortunately, the cord that connects the power adapter to the power receptacle of the electronic device is prone to cause damage to the power receptacle of the electronic device if the cord is suddenly pulled, pushed or jerked in the wrong direction, e.g., sideways or into the power receptacle. For example, it is not uncommon to pick up an electronic device that is connected to a power outlet and walk away without unplugging the cord. It is also not uncommon to trip over the cord while the electronic device is plugged into an outlet. These events cause forces to be applied to the power receptacle of the electronic device in a manner that can cause the power receptacle to be dislodged from the circuit board thereby permanently damaging the power connection. To repair the electronic device, it is often necessary to replace the entire circuit board. In many instances, this repair may cost the consumer close to the full replacement price of the electronic device.

For the reasons stated above and for other reasons stated below which will become apparent to those skilled in the art upon reading and understanding the specification, there is a need in the art for improvements in providing power to portable electronic devices.

DRAWINGS

Embodiments of the present invention can be more easily understood and further advantages and uses thereof more readily apparent, when considered in view of the detailed description and the following figures.

In accordance with common practice, the various described features are not drawn to scale but are drawn to emphasize features relevant to the embodiments of the present invention. Reference characters denote like elements throughout figures and text.

DETAILED DESCRIPTION

In the following detailed description, reference is made to the accompanying drawings that form a part hereof, and in which is shown by way of illustration specific embodiments in which the invention may be practiced. These embodiments are described in sufficient detail to enable those skilled in the art to practice the invention, and it is to be understood that other embodiments may be utilized and that logical, mechanical and electrical changes may be made without departing from the scope of the present invention. The following detailed description is, therefore, not to be taken in a limiting sense.

Figure 1:
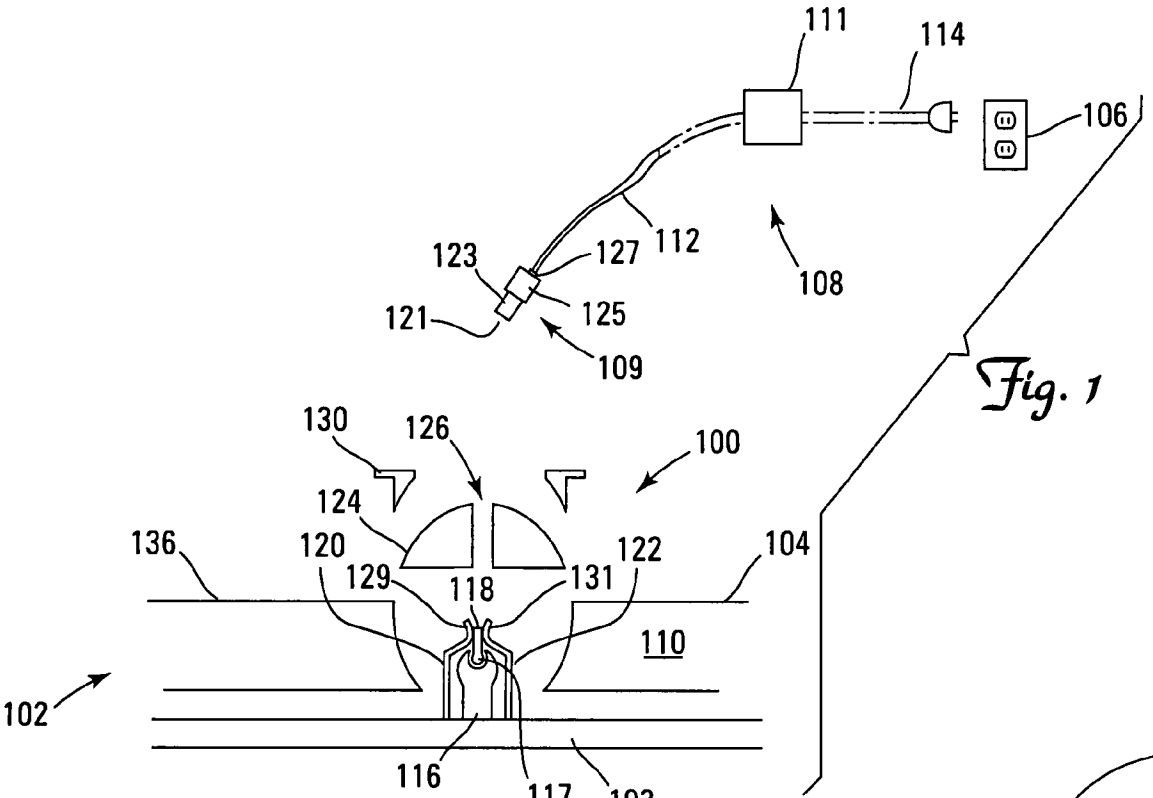
FIG. 1 is an exploded, side view in cross-section of one exemplary embodiment of a power receptacle for an electronic device in accordance with the invention.

FIG. 1 is an exploded, side view in cross-section of one exemplary embodiment of a power receptacle, indicated generally at 100, for an electronic device 102. Electronic device 102 comprises, in one embodiment, one of a notebook computer, a laptop computer, a tablet computer, a hand-held computer, a digital camera, an external drive (optical or magnetic), a wireless telephone, a personal digital assistant (PDA), an audio/video player and recorder or other portable electronic or computing device. Power receptacle 100 passes through housing 104 of electronic device 102 to enable connection to a power source for the electronic device 102. Power receptacle 100 provides an electrical connection between circuit board 103 of electronic device 102 and a source of electrical power 106, e.g., a wall socket. Circuit board 103 includes circuitry to perform the function of electronic device 102. Power is provided to the circuitry of circuit board 103 through power receptacle 100.

Power is delivered to power receptacle 100 from power adapter 108. Power adapter 108 converts between alternating current and direct current power. In this embodiment, power adapter 108 is shown with power converter 111 and cords 112 and 114. Cord 112 has a jack 109 that is adapted to couple to power receptacle 100. In one embodiment, jack 109 includes a female power connector 121, a metal contact 123 to provide a ground connection, an overmold 125 and strain relief 127. In other embodiments, the polarity of power receptacle 100 is reversed and female connector 121 is coupled to ground and metal contact 123 is at an appropriate voltage.

Cord 114 is coupled between power source 106 and power converter 111. Cord 112 is coupled between power converter 111 and power receptacle 100. It is understood that power adapter 108 is shown by way of example and not by way of limitation. Power receptacle 100 works with other types of power adapters 108, e.g., adapters with a single cord that connects to power receptacle 100. In other embodiments, the power converter circuitry of power adapter 108 is built into electronic device 102; thus, a single cord 112 with jack 109 is provided to connect power receptacle 100 to power source 106.

In one exemplary embodiment, power receptacle 100 is free to rotate within wall 110 of housing 104 to reduce the likelihood of damage to power receptacle 100 when a potentially destructive force is applied to power adapter 108, e.g., one or more of cords 112 and 114 is tugged, pulled or jerked. Power receptacle 100 includes socket 116 that is connected to circuit board 103. Socket 116 is electrically coupled to a post connector 118. In some embodiments, post connector 118 includes a ball 117 and a pin 119 extending from ball 117. Ball 117 of post connector 118 rotates within socket 116 while maintaining an electrical connection with socket 116. In one embodiment, post connector 118 rotates through an angle of approximately 90 degrees in a plane normal to the surface of wall 110. Post connector 118 also is flanked by first and second flexible ground springs 120 and 122. Each of the flexible ground springs 120 and 122 is coupled to provide a ground connection between power adapter 108 and circuit board 103. Ends 129 and 131 of flexible ground springs 120 and 122, respectively, have a curved shape and are biased toward post connector 118.

Figure 2:
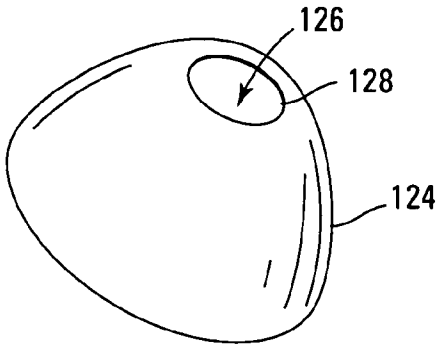
FIG. 2 is a perspective view of an exemplary embodiment of a rotating member for the power receptacle of the embodiment of FIG. 1 in accordance with the invention.

Power receptacle 100 also includes a rotating member 124 that is positioned in wall 110 of housing 104. Rotating member 124 includes an opening or channel 126. Channel 126 is adapted to receive socket 116 and post connector 118. In one embodiment, rotating member 124 comprises a semispherical body as shown in FIG. 2 with opening 126 extending radially through the body of rotating member 124. Rotating member 124 includes a grommet 128 at the opening of channel 126 that provides protection for cord 112 when power adapter 108 is coupled to power receptacle 100.

Figure 3:
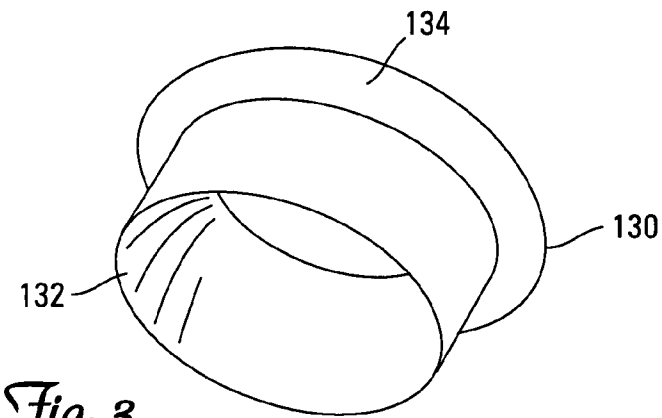
FIG. 3 is a perspective view of an exemplary embodiment of a retention ring for the power receptacle of the embodiment of FIG. 1 in accordance with the invention.

Returning to FIG. 1, rotating member 124 is retained in wall 110 by ring 130. As shown in FIG. 3, in one embodiment, ring 130 includes an interior surface 132 that matches the arc of rotating member 124. Ring 130 also includes a lip 134 that mates with the exterior surface 136 of wall 110.

Figure 5:
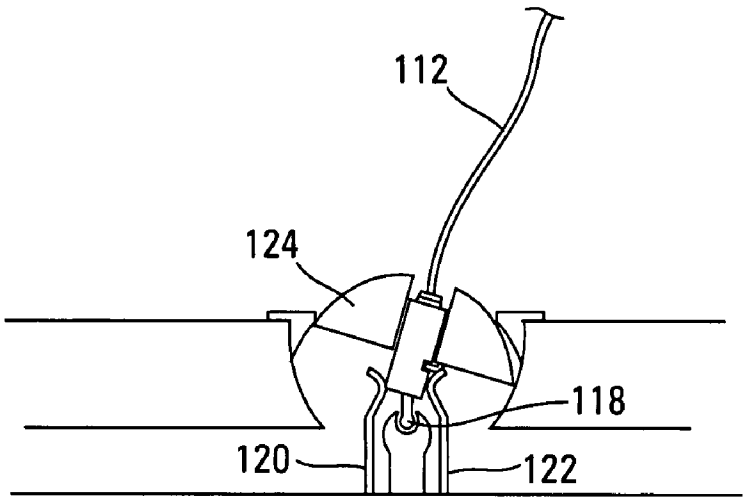
FIGS. 4 and 5 are side views in cross-section of one exemplary embodiment of a power receptacle connected to a power supply in accordance with the invention.
Figure 4:
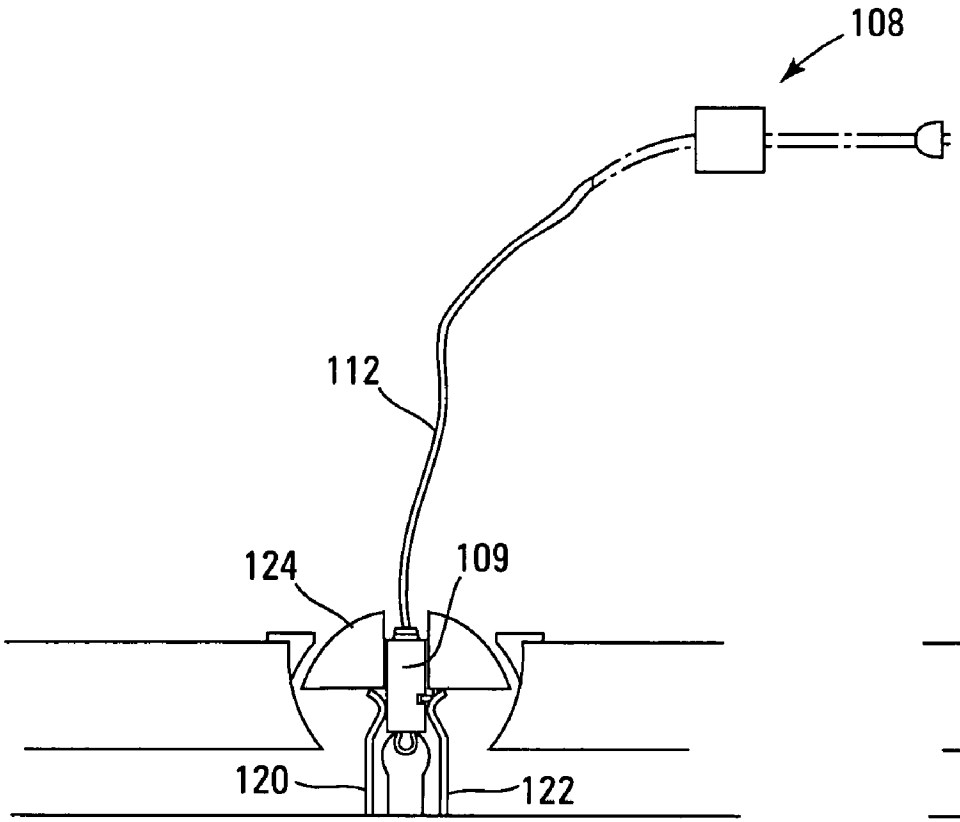

Returning to FIG. 1, ring 130 enables rotating member 124 to rotate freely in wall 110 when cord 112 of power adapter 108 is pulled, tugged or jerked. As seen in FIG. 4, jack 109 is inserted through channel 126 to engage post connector 118. Flexible ground springs 120 and 122 also engage ground connectors on jack 109. When cord 112 is pulled to the side, rotating member 124 rotates as shown in FIG. 5. Post connector 118 also rotates in socket 116 thereby maintaining the electrical connection between power adapter 108 and electrical device 102. Flexible ground springs 120 and 122 also move in response to the change in position of the jack 109 of power adapter 108 to maintain the ground connection.

Figure 6:
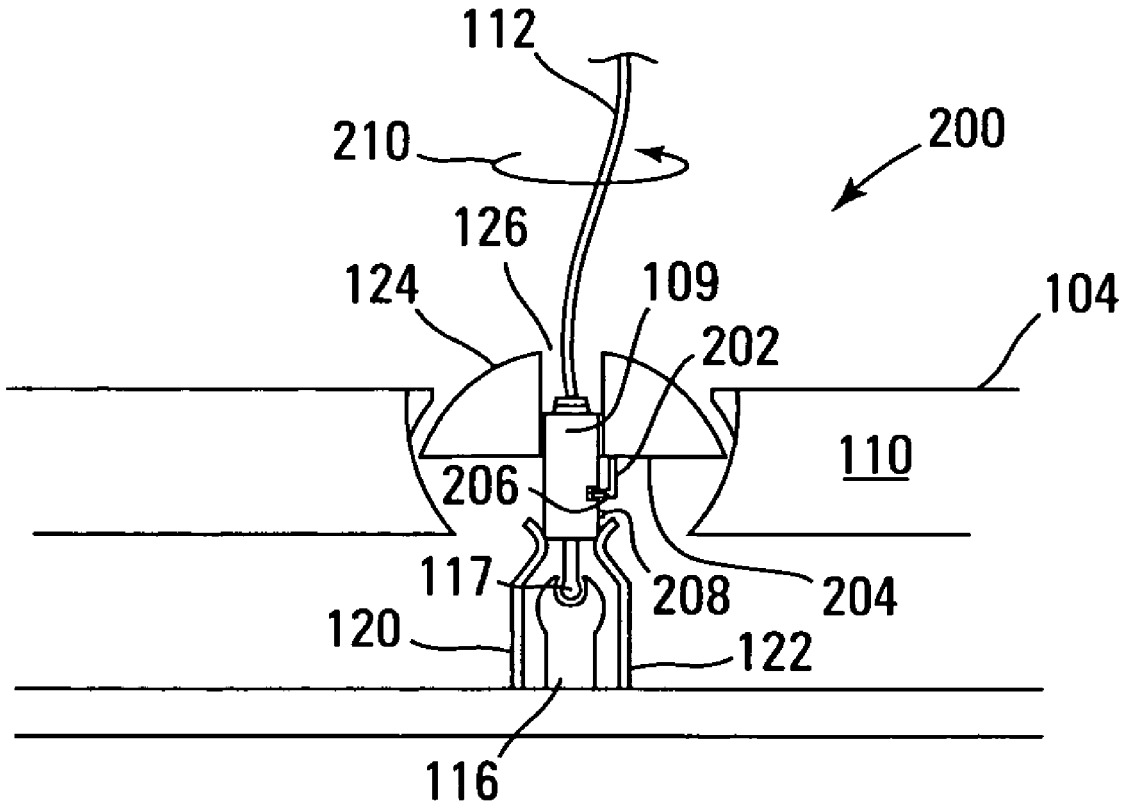
FIG. 6 is a side view in cross-section of another exemplary embodiment of a rotating power receptacle with a locking mechanism in accordance with the invention.

FIG. 6 is a side view in cross-section of another embodiment of a rotating power receptacle, indicated generally at 200, with a locking arm 202. Due to the similarities with the power receptacle 100 of FIG. 1, only the additional elements found in power receptacle 200 not included in power receptacle 100 are described here. In this embodiment, power receptacle 200 includes a locking arm 202 that extends from a bottom surface 204 of rotating member 124. Locking arm 202 is formed of a flexible material to allow the arm to snap into groove 206 in jack 109 of cord 112. When jack 109 is inserted into channel 126 in rotating member 124, locking arm 202 slides along surface 208 until it is even with groove or notch 206. To lock jack 109 in place, rotating member 124 is turned, e.g., in the direction of arrow 210 until locking arm 202 snaps into groove 206. This movement acts to lock jack 109 in place. Jack 109 is unlocked by again rotating the rotating member 124 with sufficient force to snap locking arm 202 out of groove 206.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

What is claimed is:

1. A rotating power receptacle for an electronic device, comprising:

a socket, coupled to a circuit board, and providing power to an electronic device;

a post connector, in rotating contact with the socket;

a flexible ground spring, coupled to the circuit board, the flexible ground spring extending adjacent to the post connector and providing a ground connection for the electronic device; and a rotating member, positioned in an opening in a housing of the electronic device, the rotating member having an opening through which a power supply connector is enabled to connect to the post connector and the flexible ground spring to provide a rotating power connection for the electronic device.

2. The rotating power receptacle of claim 1, wherein the rotating member comprises a substantially hemispherical body with an opening extending radially through the body.

3. The rotating power receptacle of claim 1, wherein the post connector includes a ball that rests in the socket and a pin that extends from the ball.

4. The rotating power receptacle of claim 1, wherein the flexible ground spring comprises an end with a curved portion that is biased in contact with the post connector when the power supply connector is not connected to the receptacle.

5. The rotating power receptacle of claim 1, wherein the opening of the rotating member comprises a grommet.

6. The rotating power receptacle of claim 1, and further comprising a retaining ring that is coupled to the housing of the electronic device to hold the rotating member in the housing.

7. The rotating power receptacle of claim 1, and further including a locking arm extending from a bottom surface of the rotating member.

8. A power receptacle for an electronic device, comprising:

means for coupling power from a power supply to a circuit board of the electronic device;

means for enclosing the circuit board; and means, associated with the means for coupling and positioned in the means for enclosing, for rotating the orientation about a point with at least two rotational degrees of freedom of the means for coupling in response to external forces.

9. The power receptacle of claim 8, wherein the means for coupling comprises:

means for providing a flexible grounding for the power supply; and means for providing a rotating power connection for the power supply.

10. The power receptacle of claim 8, wherein the means for rotating includes means for retaining the means for rotating.

11. The power receptacle of claim 8, wherein the means for rotating includes means for protecting a cord of the power supply.

12. The power receptacle of claim 8, and further including means, coupled to the means for rotating, for locking a power jack to the means for coupling power.

13. A method for preventing damage to a power receptacle, the method comprising:

receiving a power jack of a power adapter in the power receptacle to provide power to an electronic device; and rotating the power jack about a point, wherein the power jack is free to rotate with respect to at least two axes, to reduce the impact on the power receptacle from forces applied to the power adapter.

14. The method of claim 13, wherein receiving the power jack comprises receiving the power jack through a rotating member of a power receptacle positioned in a housing of an electronic device.

15. The method of claim 13, wherein receiving a power jack comprises:

inserting a post of the receptacle in the power jack; and contacting a ground connection of the power jack with at least one flexible ground spring.

16. The method of claim 13, wherein rotating the power jack comprises:

rotating a rotating member of the power receptacle in a recess in the housing of the electronic device; and rotating a post connection of the power receptacle to maintain contact with the power jack.

17. The method of claim 13, and further including locking the power adapter in the power receptacle.

18. An electronic device, comprising:

a housing;

a circuit board disposed in the housing and having a circuit for performing a function; and a power receptacle, coupled to the circuit board, the power receptacle including a rotating member having a semi-spherical body positioned in the housing to enable the power receptacle to rotate while maintaining a power connection to a power adapter for the functional circuit.

19. The electronic device of claim 18, wherein the power receptacle comprises a ring that maintains the rotating member in a recess in the housing.

20. The electronic device of claim 18, wherein the power receptacle comprises a connector socket coupled to the circuit board with a power post rotatably coupled to the connector socket.

21. The electronic device of claim 18, wherein the rotating member comprises a channel for receiving a jack of a power adapter to enable connection to the power receptacle.

22. The electronic device of claim 21, wherein the rotating member includes a grommet around the channel to protect the power adapter.

23. The electronic device of claim 18, and further including flexible ground springs coupled to the circuit board to provide ground connection for the power adapter.

* * * * *

UNITED STATES PATENT AND TRADEMARK OFFICE

CERTIFICATE OF CORRECTION

PATENT NO. : 7,393,212 B2
APPLICATION NO. : 11/238325
DATED : July 1, 2008
INVENTOR(S) : Jeffrey C. Parker It is certified that error appears in the above-identified patent and that said Letters Patent is hereby corrected as shown below:

On the title page, item (56), under "Foreign Patent Documents", in column 2, line 1, delete "09 017460" and insert -- 09 017480 --, therefor.

Signed and Sealed this

Third Day of March, 2009

JOHN DOLL
*Acting Director of the United States Patent and Trademark Office*